US008594356B2

(12) United States Patent
Ahsani

(10) Patent No.: US 8,594,356 B2
(45) Date of Patent: Nov. 26, 2013

(54) BONE CONDUCTION DEVICE HAVING LIMITED RANGE OF TRAVEL

(75) Inventor: Sami Ahsani, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 494 days.

(21) Appl. No.: 12/770,549

(22) Filed: Apr. 29, 2010

(65) Prior Publication Data

US 2011/0268303 A1 Nov. 3, 2011

(51) Int. Cl.
*H04R 25/00* (2006.01)

(52) U.S. Cl.
USPC ..... 381/326; 381/151; 600/25

(58) Field of Classification Search
USPC ..... 381/326, 151; 600/25
See application file for complete search history.

(56) References Cited

U.S. PATENT DOCUMENTS

| | | | | |
|---|---|---|---|---|
| 1,969,559 | A * | 8/1934 | Kelly | 381/151 |
| 2,832,842 | A * | 4/1958 | Knauert | 381/151 |
| 3,594,514 | A * | 7/1971 | Wingrove | 600/25 |
| 5,735,790 | A * | 4/1998 | Håkansson et al. | 600/25 |
| 5,935,170 | A * | 8/1999 | Håkansson et al. | 600/25 |
| 6,033,440 | A | 3/2000 | Schall et al. | |
| 6,626,909 | B2 | 9/2003 | Chin | |
| 7,021,676 | B2 | 4/2006 | Westerkull | |
| 7,065,223 | B2 * | 6/2006 | Westerkull | 381/326 |
| 7,116,794 | B2 * | 10/2006 | Westerkull | 381/326 |
| 7,198,596 | B2 * | 4/2007 | Westerkull | 600/25 |
| 7,857,854 | B2 | 12/2010 | Sweeney | |
| 8,150,083 | B2 * | 4/2012 | Parker et al. | 381/326 |
| 2001/0031908 | A1 * | 10/2001 | Buschek et al. | 600/25 |
| 2004/0032962 | A1 * | 2/2004 | Westerkull | 381/151 |
| 2004/0204713 | A1 * | 10/2004 | Abdou | 606/71 |
| 2005/0020873 | A1 * | 1/2005 | Berrang et al. | 600/25 |
| 2005/0248158 | A1 * | 11/2005 | Westerkull | 285/411 |
| 2005/0273166 | A1 | 12/2005 | Sweeney | |
| 2006/0025648 | A1 * | 2/2006 | Lupin et al. | 600/25 |
| 2006/0045298 | A1 * | 3/2006 | Westerkull | 381/326 |
| 2006/0116743 | A1 * | 6/2006 | Gibson et al. | 607/57 |
| 2006/0189999 | A1 | 8/2006 | Zwirkoski | |
| 2007/0053536 | A1 * | 3/2007 | Westerkull | 381/326 |
| 2007/0156011 | A1 * | 7/2007 | Westerkull | 600/25 |
| 2007/0191673 | A1 * | 8/2007 | Ball et al. | 600/25 |
| 2008/0292125 | A1 | 11/2008 | Asnes | |
| 2009/0023109 | A1 * | 1/2009 | Jinton et al. | 433/174 |
| 2009/0082817 | A1 * | 3/2009 | Jinton et al. | 606/301 |

(Continued)

FOREIGN PATENT DOCUMENTS

| | | |
|---|---|---|
| EP | 0996391 | 5/2000 |
| WO | WO 02/09622 | 2/2002 |

(Continued)

*Primary Examiner* — David Warren
*Assistant Examiner* — Christina Russell
(74) *Attorney, Agent, or Firm* — Kilpatrick, Townsend & Stockton, LLP.

(57) ABSTRACT

A bone conduction device configured to couple to an abutment of an anchor system anchored to a recipient's skull. The bone conduction device includes a housing and a vibrating actuator movably suspended in the housing and configured to vibrate in response to sound signals received by the bone conduction device The bone conduction device further includes a coupling apparatus configured to attach the bone conduction device to the abutment so as to deliver to the recipient's skull vibrations generated by the vibrating actuator, and a travel limit apparatus configured to limit a range of travel of the housing relative to the coupling apparatus.

29 Claims, 8 Drawing Sheets

(56) References Cited

U.S. PATENT DOCUMENTS

| | | | | |
|---|---|---|---|---|
| 2009/0141919 | A1* | 6/2009 | Spitaels et al. | 381/326 |
| 2009/0192345 | A1* | 7/2009 | Westerkull et al. | 600/25 |
| 2009/0245553 | A1* | 10/2009 | Parker | 381/326 |
| 2009/0245554 | A1* | 10/2009 | Parker | 381/326 |
| 2009/0245556 | A1* | 10/2009 | Parker et al. | 381/326 |
| 2009/0245557 | A1* | 10/2009 | Parker | 381/326 |
| 2009/0247810 | A1* | 10/2009 | Parker et al. | 600/25 |
| 2009/0247812 | A1* | 10/2009 | Parker et al. | 600/25 |
| 2009/0248023 | A1* | 10/2009 | Parker | 606/60 |
| 2009/0248085 | A1* | 10/2009 | Parker | 606/300 |
| 2009/0248086 | A1* | 10/2009 | Parker | 606/300 |
| 2009/0248155 | A1* | 10/2009 | Parker | 623/10 |
| 2009/0259091 | A1* | 10/2009 | Parker | 600/25 |

FOREIGN PATENT DOCUMENTS

| | | |
|---|---|---|
| WO | WO 03/001845 | 1/2003 |
| WO | WO 03/001846 | 1/2003 |
| WO | WO2004105650 | 12/2004 |

* cited by examiner

BONE CONDUCTION DEVICE HAVING LIMITED RANGE OF TRAVEL

BACKGROUND

1. Field of the Invention

The present invention relates generally to hearing prostheses, and more particularly, to a bone conduction device having a limited range of travel.

2. Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array directly to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid, referred to as a hearing aid herein. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

Unfortunately, not all individuals suffering from conductive hearing loss are able to derive suitable benefit from hearing aids. For example, some individuals are prone to chronic inflammation or infection of the ear canal thereby eliminating hearing aids as a potential solution. Other individuals have malformed or absent outer ear and/or ear canals resulting from a birth defect, or medical condition such as Treacher Collins syndrome or Microtia. Furthermore, hearing aids are typically unsuitable for individuals who suffer from single-sided deafness (total hearing loss only in one ear). Additionally, in order to prevent undesirable acoustic feedback, hearing aids generally require that the ear canal be occluded, resulting in unnecessary pressure, discomfort, or other undesirable side effects such as eczema.

In contrast to hearing aids, which rely primarily on the principles of air conduction, certain types of hearing prostheses commonly referred to as bone conduction devices, convert a received sound into vibrations. The vibrations are transferred through the skull to the cochlea causing in the generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In a first embodiment of the present invention, there is a bone conduction device configured to couple to an abutment of an anchor system anchored to a recipient's skull. The bone conduction device comprises a housing and a vibrating actuator movably suspended in the housing and configured to vibrate in response to sound signals received by the bone conduction device The bone conduction device further comprises a coupling apparatus configured to attach the bone conduction device to the abutment so as to deliver to the recipient's skull vibrations generated by the vibrating actuator, and a travel limit apparatus configured to limit a range of travel of the housing relative to the coupling apparatus.

In another embodiment of the present invention, there is a bone conduction device configured to couple to an abutment of an anchor system anchored to a recipient's skull. The bone conduction device comprises a housing and a vibrating actuator movably suspended in the housing and configured to vibrate in response to sound signals received by the bone conduction device. The bone conduction device further comprises a coupling apparatus including a coupling configured to attach the bone conduction device to the abutment so as to deliver to the recipient's skull vibrations generated the vibrating actuator, and a travel limit apparatus configured to limit a range of travel of the housing relative to the vibrating actuator.

In another embodiment of the present invention, there is a method for preventing damage to a bone conduction device, the device having a vibrating actuator attached to a coupling apparatus movably suspended from a housing. The method comprises receiving a force applied to the housing. The method further comprises, while the force is applied, moving the housing relative to the coupling apparatus in response to the force, and mechanically stopping the relative travel of the housing to the coupling apparatus prior to the vibrating actuator contacting the housing.

BRIEF DESCRIPTION OF THE DRAWINGS

Embodiments of the present invention are described below with reference to the attached drawings, in which.

DETAILED DESCRIPTION

Aspects of the present invention are generally directed to a bone conduction device in which the range of travel of device components is limited to reduce the likelihood of damage to the device. In an exemplary embodiment, the bone conduction device comprises a housing, a vibrating actuator, a coupling apparatus and a travel limit apparatus. The coupling apparatus is removably attached to an anchor system implanted in the recipient. The actuator is suspended in the housing and attached to the coupling apparatus to facilitate the transfer of vibrations to the recipient's skull. When the device is attached/detached to/from the anchor system, the travel limit apparatus limits movement of the housing relative to the coupling apparatus and the vibrating actuator preventing the actuator from contacting the housing.

Figure 1:
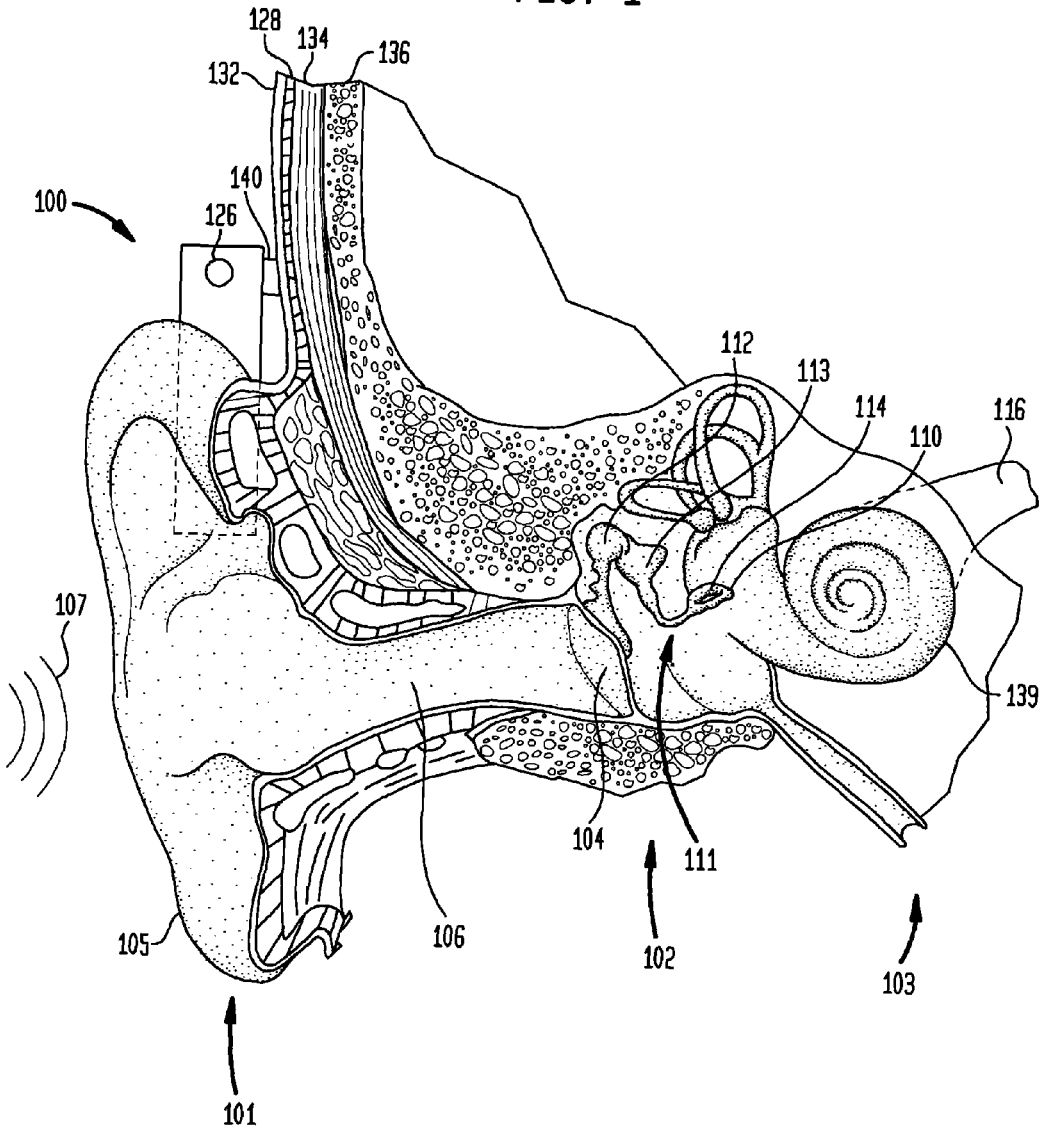
FIG. 1 is a perspective view of an exemplary bone conduction device in which embodiments of the present invention may be advantageously implemented.

FIG. 7 is a schematic diagram of a bone conduction device including a travel limit apparatus, in accordance with an embodiment of the invention;

FIG. 1 is a perspective view of a bone conduction device 100 in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify acoustic wave 107, causing oval window 110 to articulate, or vibrate. Such vibration sets up waves of fluid motion within cochlea 139. Such fluid motion, in turn, activates tiny hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element may comprise, for example, a microphone, telecoil, etc. In an exemplary embodiment, sound input element 126 may be located, for example, on or in bone conduction device, in the bone conduction device 100, or on a cable extending from the bone conduction device 100.

Also, bone conduction device 100 comprises a sound processor, a vibrating actuator (which in an exemplary embodiment is a vibrating actuator) and/or various other operational components. More particularly, microphone 126 converts received sound signals into electrical signals. These electrical signals are processed by the sound processor. The sound processor generates control signals which cause the actuator to vibrate. In other words, the actuator converts the electrical signals into mechanical motion to deliver vibrations to the recipient's skull.

In accordance with an embodiment, bone conduction device 100 further includes a coupling apparatus 140 configured to attach the device to the recipient. In the specific embodiments of FIG. 1, coupling apparatus 140 is attached to an anchor system (not shown) implanted in the recipient. An exemplary anchor system (also referred to as a fixation system) may include a percutaneous abutment fixed to the recipient's skull bone 136. The abutment extends from bone 136 through muscle 134, fat 128 and skin 132 so that coupling apparatus 140 may be attached thereto. Such a percutaneous abutment provides an attachment location for coupling apparatus 140 that facilitates efficient transmission of mechanical force. Cochlear sells its bone conduction device under the Baha trademark.

It will be appreciated that embodiments may be implemented with other types of couplings and anchor systems. Exemplary couplings and anchor systems that may be implemented in accordance with embodiments of the present invention include those described in the following commonly owned and co-pending U.S. Patent Applications: U.S. patent application Ser. Nos. 12/177,091, 12/167,796, 12/167,851, 12/167,871, 12/167,825, 12/168,636, 12/168,603, and 12/168,620. Additional couplings and/or anchor systems which may be implemented are described in U.S. Pat. No. 3,594,514, U.S. Patent Publication No. 2005/0020873, U.S. Patent Publication No. 2007/0191673, U.S. Patent Publication No. 2007/0156011, U.S. Patent Publication No. 2004/0032962, U.S. Patent Publication No. 2006/0116743 and International Application No. PCT/SE2008/000336.

Figure 2:
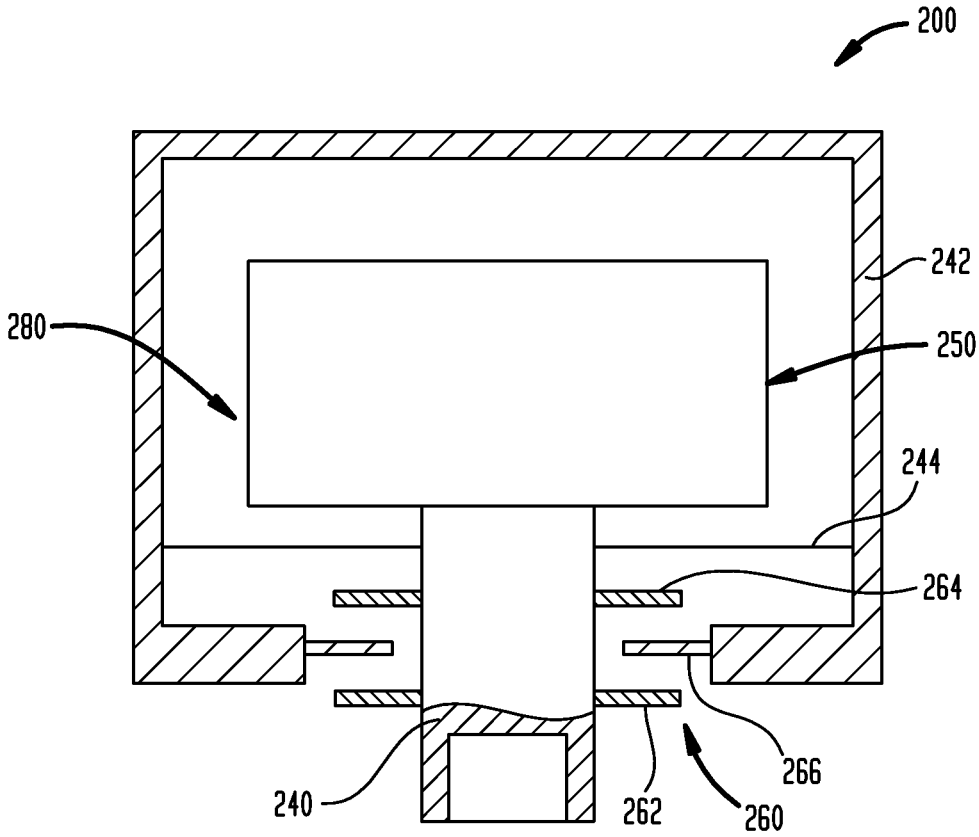
FIG. 2 is a schematic diagram of a bone conduction device including a travel limit apparatus, in accordance with an embodiment of the invention.

FIG. 2 provides a schematic diagram of a bone conduction device 200 comprising a travel limit apparatus, in accordance with an embodiment of the invention. Bone conduction device 200 includes a housing 242, a vibrating actuator 250, a coupling apparatus 240 that extends from housing 242 and is mechanically linked to vibrating actuator 250, and a travel limit apparatus 260 configured to limit movement of the housing relative to the coupling apparatus 240. Collectively, vibrating actuator 250 and coupling apparatus 240 form a vibrating actuator-coupling assembly 280. Vibrating actuator-coupling assembly 280 is suspended in housing 242 by spring 244. In an exemplary embodiment, the spring 244 is connected to the coupling apparatus 240, and the vibrating actuator 250 is supported by the coupling apparatus 240. As noted above, the travel limit apparatus 260 limits movement of components of the bone conduction device 200 relative to one another, thus reducing the likelihood that the bone conduction device 200 may become damaged. Specifically, the travel limit apparatus 260 includes a first structural element 262, a second structural element 264, and a third structural element 266. For ease of explanation, the first structural element 262, the second structural element 264 and the third structural element 266 will be referred to, respectively, as stop flange 262, stop washer 264, and platform flange 266. Stop flange 262 extends from the coupling apparatus 240. Stop flange 262 acts as a stop to limit travel of the housing 242 relative to the coupling apparatus 240, as will be explained in greater detail below. Stop washer 264 extends from the coupling apparatus 240. Stop washer 264 acts as a stop to limit travel of the housing 242 relative to the coupling apparatus 240, as will also be explained in greater detail below. Platform flange 266 forms a platform extending from the housing 242, and travels between the stop flange 262 and the stop washer 264. It should be understood, however, that in other embodiments, other types of structural elements may be used as first, second and third structural elements. Examples of such alternative embodiments will be discussed below.

Figure 3:
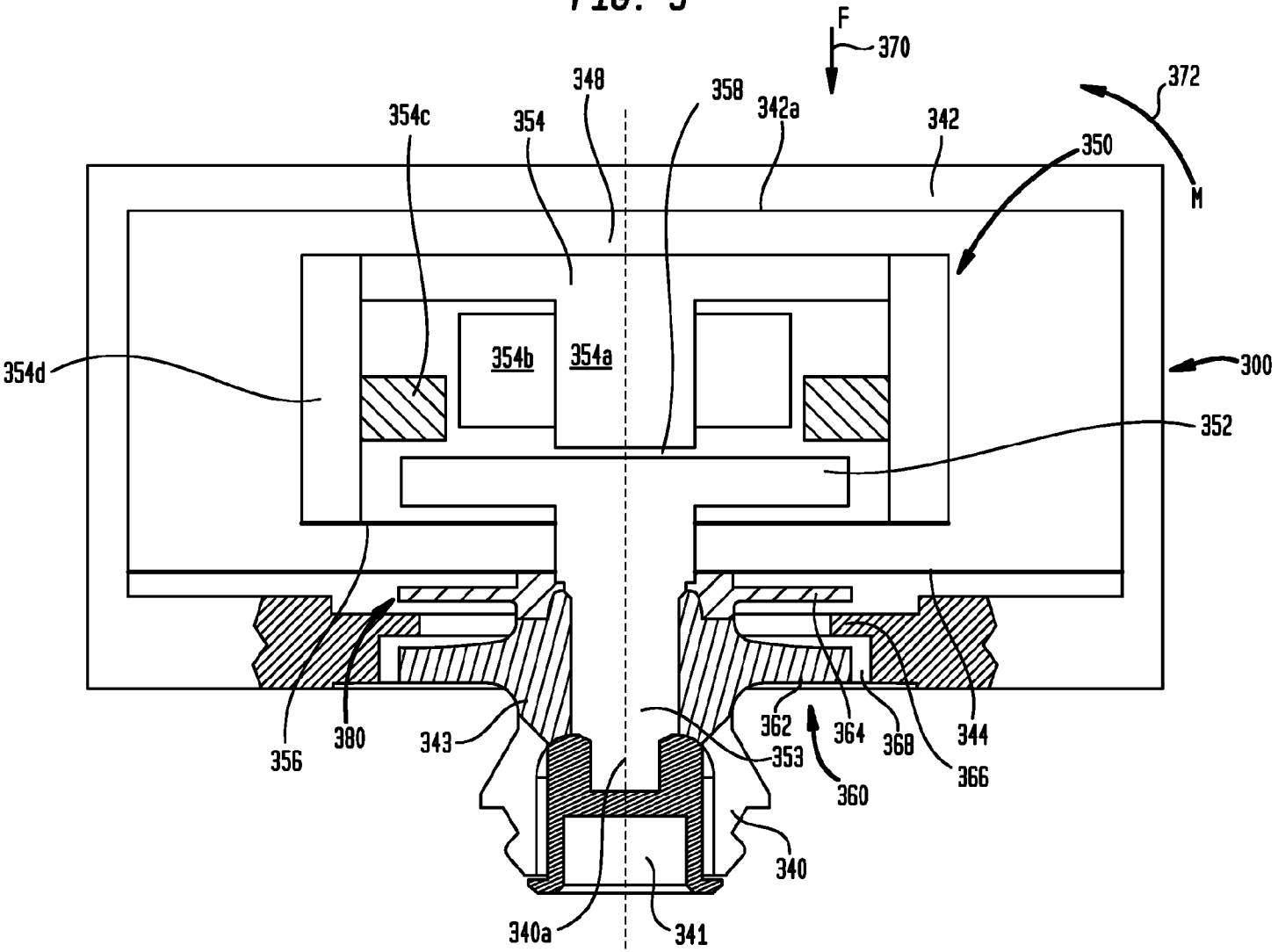
FIG. 3 is a perspective view of a bone conduction device, in accordance with an embodiment of the invention.

FIG. 3 presents a perspective view of a bone conduction device 300 according to an embodiment. Functionally, bone conduction device 300 corresponds to bone conduction device 200 as it pertains to the housing 242, the travel limit apparatus 260 and the vibrating actuator-coupling assembly 280 and the associated components. FIG. 3 depicts housing 342 connected to the vibrating actuator-coupling assembly 380 (which includes vibrating actuator 350 and coupling apparatus 340) by spring 344. Travel limit apparatus 360 corresponds to travel limit apparatus 260 of FIG. 2, and includes stop flange 362, stop washer 364, and platform flange 366. In an embodiment, when attachment/removal forces are not applied to housing 342, platform flange 366 is located approximately equidistant between stop flange 362 and stop washer 364, as is illustrated in FIG. 3. Alternatively, in an embodiment, when attachment/removal forces are not applied to housing 342, platform flange 366 may be located at various locations between stop flange 362 and stop washer 364.

Figure 4:
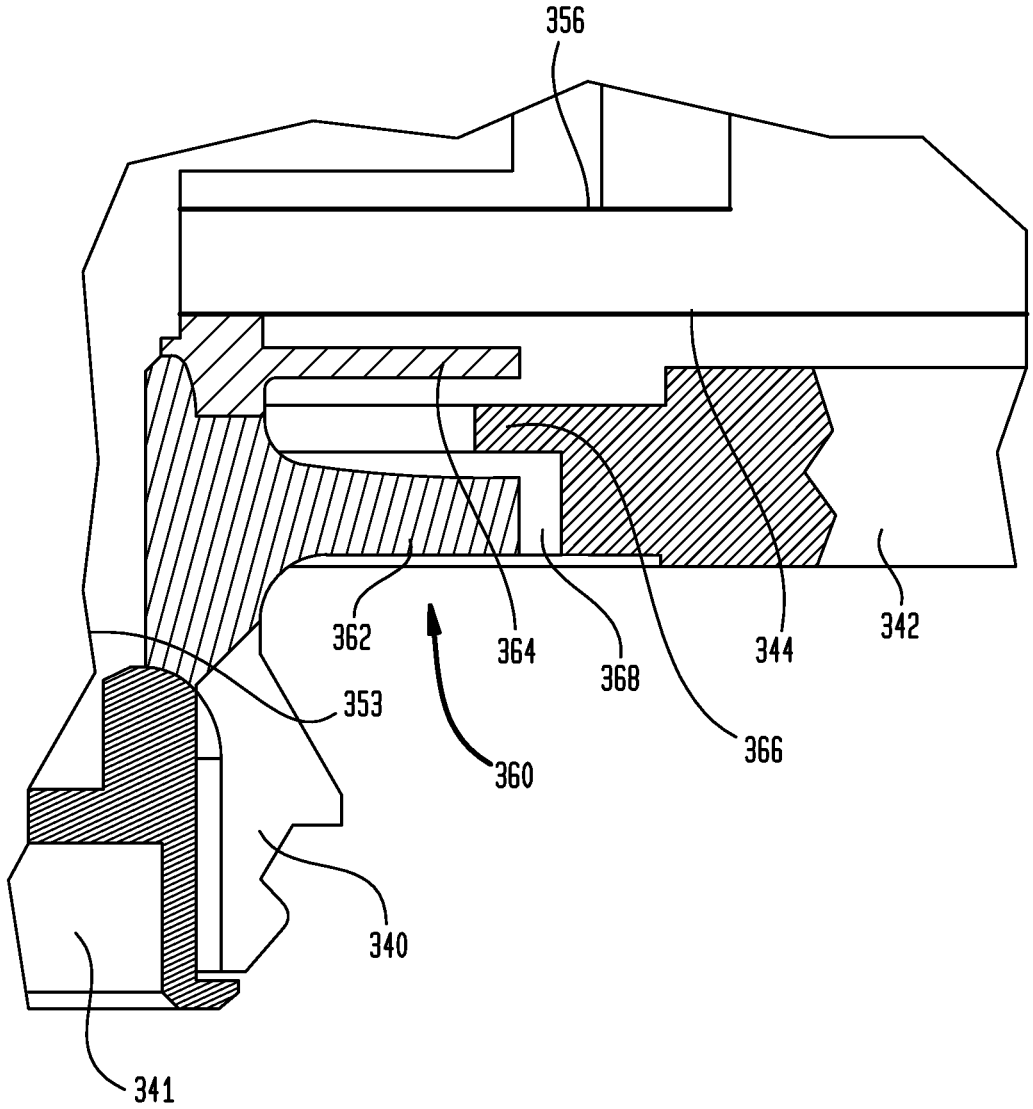
FIG. 4 presents an enlarged view of the travel limit apparatus utilized in the bone conduction device of FIG. 3, in accordance with embodiments of the invention.

FIG. 4 provides an enlarged view of a portion of bone conduction device 300 including the travel limit apparatus 360 in accordance with an embodiment of the invention. The stop flange 362 and the stop washer 364 are rigidly mechanically linked to the coupling apparatus 340 (stop flange 362 is an integral part of the coupling apparatus 340). By rigidly mechanically linked it is meant that the components do not move relative to one another, either via elastic deformation (other than minor elastic deformation—the elastic deformation that is inherent in all structures) of those components, or via elastic deformation of intervening components (again, other than minor elastic deformation). The travel limit apparatus 360 further includes platform flange 366 that is rigidly mechanically linked to the housing 342. The stop flange and stop washer 362 and 364 sandwich, with respect to the longitudinal axis 340*a* (see FIG. 3), platform flange 366, such that platform flange 366 is limited to travel between the stop flange and the stop washer 362 and 364, and may not travel beyond those elements.

Additional elements of the bone conduction device 300 will now be described so as to provide a frame of reference to understand how the various components of the bone conduction device may become damaged. This will be followed by an expanded description of the travel limit apparatus 360 and a description of how the travel limit apparatus 360 limits the potential for damage to bone conduction device 300.

As illustrated, the coupling apparatus 340 includes a coupling 341 in the form of a snap coupling configured to "snap couple" to an anchor system on the recipient. As noted above with reference to FIG. 1, the anchor system may include an abutment that is attached to a fixture screw implanted into the recipient's skull. The abutment extends percutaneously through the skin so that the snap coupling 341 of the coupling apparatus 340 can snap couple to a coupling of the abutment of the anchor system. In the embodiment depicted in FIG. 3, the coupling 341 is located at a distal end, relative to the housing 342, of a coupling shaft 343 of the coupling apparatus 340.

In an embodiment, the coupling 341 corresponds to the coupling described in U.S. patent application Ser. No. 12/177,091 assigned to Cochlear Limited. In an alternate embodiment, a snap coupling such as that described in U.S. patent application Ser. No. 12/167,796 assigned to Cochlear Limited is used instead of coupling 341. In yet a further alternate embodiment, a magnetic coupling such as that described in U.S. patent application Ser. No. 12/167,851 assigned Cochlear Limited is used instead of or in addition to coupling 341 or the snap coupling of U.S. patent application Ser. No. 12/167,796.

The coupling apparatus 340 is mechanically coupled to vibrating actuator 350. In an exemplary embodiment, the vibrating actuator 350 is a device that converts electrical signals into vibration. In operation, sound input element 126 (FIG. 1) converts sound into electrical signals. Specifically, the bone conduction device provides these electrical signals to vibrating actuator 350, or to a sound processor that processes the electrical signals, and then provides those processed signals to vibrating actuator 350. The vibrating actuator 350 converts the electrical signals (processed or unprocessed) into vibrations. Because vibrating actuator 350 is mechanically coupled to coupling apparatus 340, the vibrations are transferred from the vibrating actuator 350 to the coupling apparatus 340 and then to the recipient via the anchor system (not shown). In an exemplary embodiment, the vibrating actuator 350 includes a vibrating actuator plate 352, vibrating actuator shaft 353, bobbin assembly 354 and internal spring 356. As illustrated, the bobbin assembly 354 includes a bobbin 354*a*, a coil 354*b*, a magnet 354*c* and a counterweight 354*d*. As shown, bobbin assembly 354 is opposite the vibrating actuator plate 352. The components of the bobbin assembly 354 move relative to the vibrating actuator plate 352, and thus the vibrating actuator shaft 353 which is integral with the vibrating actuator plate 352, when the vibrating actuator 350 is energized. This movement generates the vibration of the vibrating actuator 350.

Referring to FIG. 3, the bobbin assembly 354 is coupled to the vibrating actuator plate 352 and vibrating actuator shaft 353 by internal spring 356. Internal spring 356 extends from vibrating actuator shaft 353, and is connected to counterweight 354*d*. Counterweight 354*d* is connected to bobbin 354*a*, and thus the internal spring 356 couples the bobbin assembly 354 to the vibrating actuator plate 352 and vibrating actuator shaft 353. In an embodiment, internal spring 356 may be a plate spring, a coil spring, a leaf spring, or any type of spring that will permit the bone conduction device 300 to function.

Internal spring 356 supports the bobbin assembly 354 above the vibrating actuator plate 352. As shown in FIG. 3, an air gap (space) 358 is located between the upper side of vibrating actuator plate 352 and the lower side of bobbin assembly 354. When vibrating actuator 350 is energized, a magnetic circuit is formed between bobbin assembly 354 and vibrating actuator plate 352 such that the bobbin assembly 354 is alternately attracted and repelled from vibrating actuator plate 352 (or visa-versa). Because internal spring 356 is flexible, bobbin assembly 354 can move relative to the vibrating actuator plate 352. When vibrating actuator 350 is energized, the magnetic circuit causes the bobbin assembly 354 to reciprocatingly move relative to vibrating actuator plate 352 (or visa-versa) up and down (relative to the view of FIG. 3) in a direction along the longitudinal axis 340*a* of the coupling apparatus 340. This movement creates the vibrations that are transferred via the coupling apparatus 340 to the recipient.

In the illustrated embodiment of FIG. 3, an air gap 358 may be seen between the vibrating actuator plate 352 and the bobbin assembly 354. In the illustrated embodiment, the air gap 358 is devoid of structure. In some embodiments, the air gap 358 may be filled with a fluid such as air or gas or a liquid, and/or a like substance (e.g., filled with a gel or the like), and may be a simple space between the vibrating actuator plate 352 and the bobbin assembly 354 (or other pertinent components). If the air gap 358 is eliminated and/or otherwise disturbed or changed from predefined parameters (e.g., distance between the vibrating actuator plate 352 and the bobbin 354A is permanently changed and/or eliminated, etc.) the performance of the bone conduction device 300 vis-a-vis hearing enhancement may be impaired or otherwise significantly degraded.

Still referring to FIG. 3, the vibrating actuator 350 is coupled to the housing 342 of the bone conduction device 300 by external spring 344. In an exemplary embodiment, external spring 344 is a plate spring that extends from an interior of the housing 342 to the coupling apparatus 340 and/or to the vibrating actuator shaft 353. Because of the flexibility of the external spring 344, the housing 342 can move relative to the vibrating actuator 350 and the coupling apparatus 340. In an embodiment, the external spring 344 isolates the vibrations generated by the vibrating actuator 350 from the housing 342. In an embodiment, external spring 344 may be a plate spring, a coil spring, a leaf spring, or any type of spring that will permit the bone conduction device 300 to function.

Referring back to FIG. 3, the bone conduction device 300 may be attached and/or removed from the anchor system by the recipient applying an attachment force and/or a removal force, respectively, by gripping the housing 342. During attachment and/or removal, the external spring 344 reacts against the attachment/removal force to hold the coupling apparatus 340, and thus the vibrating actuator 350, to the housing 342. The k value of the external spring 344 may be set low to improve performance of the bone conduction device 300. Having a low k value, however, may permit the vibrating actuator 350 and the coupling apparatus 340 to move significantly relative to the housing 342 if a large attachment/removal force is applied to the housing 342.

In an embodiment, a recipient may apply a large attachment force 370 to the housing 342 (i.e., a force applied downward, relative to the view of FIG. 3, along axis 340*a*) during which the coupling apparatus 340 may react against the fixture system of the recipient (an immovable object relative to the bone conduction device 300). If the travel limit apparatus 360 is not included with the bone conduction device 300, this large attachment force 370 could cause the housing 342 to move towards vibrating actuator 350 such that the air gap (space) 348 between the top of the bobbin assembly 354 and the interior ceiling 342*a* of the housing 342 is eliminated. In such a scenario, the ceiling 342*a* of the housing 342 would strike the top of the bobbin assembly 354, and apply a downward force on the bobbin assembly 354. This downward force could potentially eliminate the air gap 358 between the bobbin assembly 354 and the vibrating actuator plate 352. That is, if the interior ceiling 342*a* of the housing 342 strikes the bobbin assembly 354, the bobbin assembly 354 could be forced down onto the vibrating actuator plate 352. This could damage the vibrating actuator 350 by altering the parameters of the air gap 358 and/or eliminating the air gap 358 entirely as a result of, for example, deformation (e.g., plastic deformation) of certain components of the vibrating actuator 350 and/or damage to components of the vibrating actuator 350. Still further, even if the air gap 358 were retained after the ceiling 342*a* strikes the bobbin assembly 354, the components of the vibrating actuator 350 could be damaged, which in turn could cause the performance of the bone conduction device to be degraded to an unacceptable level.

In another embodiment, the bone conduction device may include litz wires (not shown) that provide energy to the vibrating actuator 350. These litz wires could be damaged if the housing 342 strikes the vibrating actuator 350.

Further, if a large removal force is applied to the housing (i.e., a force opposite the direction of force 370), components of the bone conduction device 300 could be damaged if the travel limit apparatus 360 is not employed. For example, the external spring 344 could be plastically deformed, etc.

In an exemplary embodiment, the travel limit apparatus 360 limits movement of the housing 342 relative to the coupling apparatus 340, and thus relative to the vibrating actuator 350. Travel limit apparatus 360 maintains an air gap 348 between the bobbin assembly 354 and the ceiling 342*a* of the housing 342 by limiting movement of the housing 342 relative to the coupling apparatus 340 and the vibrating actuator 350 along the longitudinal axis 340*a*.

Figure 5A:
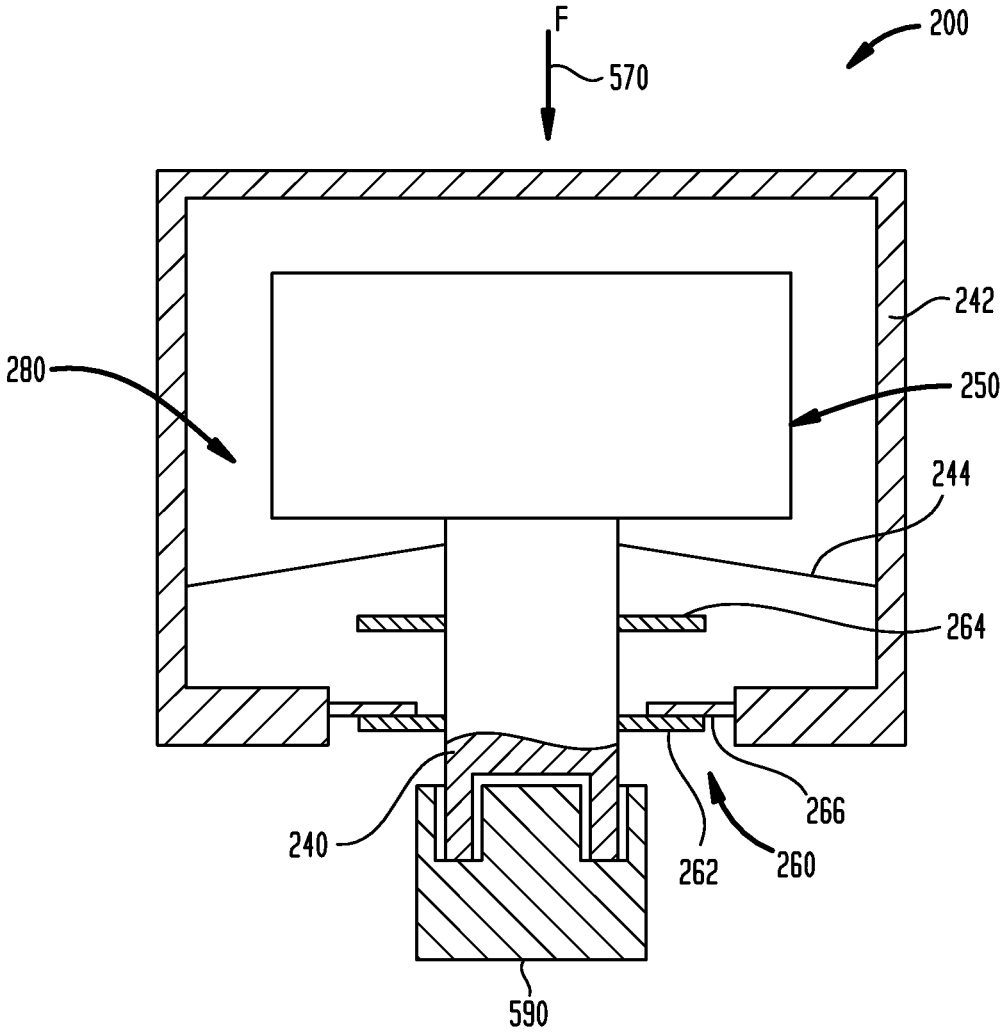
FIG. 5A is a schematic diagram of an embodiment of the bone conduction device of FIG. 2 depicting movement of the housing relative to the vibrating actuator-coupling assembly when a downward force is applied to the housing.

As noted above, the functionality of the travel limit apparatus 360 of FIG. 3 is depicted in FIG. 2. In this regard, FIG. 5A provides a diagram depicting movement of the housing 242 of FIG. 2 relative to the vibrating actuator-coupling assembly 280 as a result of a downward force 570 (an attachment force) applied to the bone conduction device 200 corresponding to bone conduction device 300 of FIG. 3. In FIG. 5A, abutment 590 of an anchor system attached to a recipient's skull reacts against that downward force 570, preventing the vibrating actuator-coupling assembly 280 from further moving downward. The downward movement of the housing 242 is limited by travel limit apparatus 260, as may be seen in FIG. 5A. Specifically, in FIG. 5A, platform flange 266 strikes stop flange 262 to halt further travel of housing 242. This prevents vibrating actuator 250 from striking the housing 242, thus preventing damage to vibrating actuator 250.

Figure 5B:
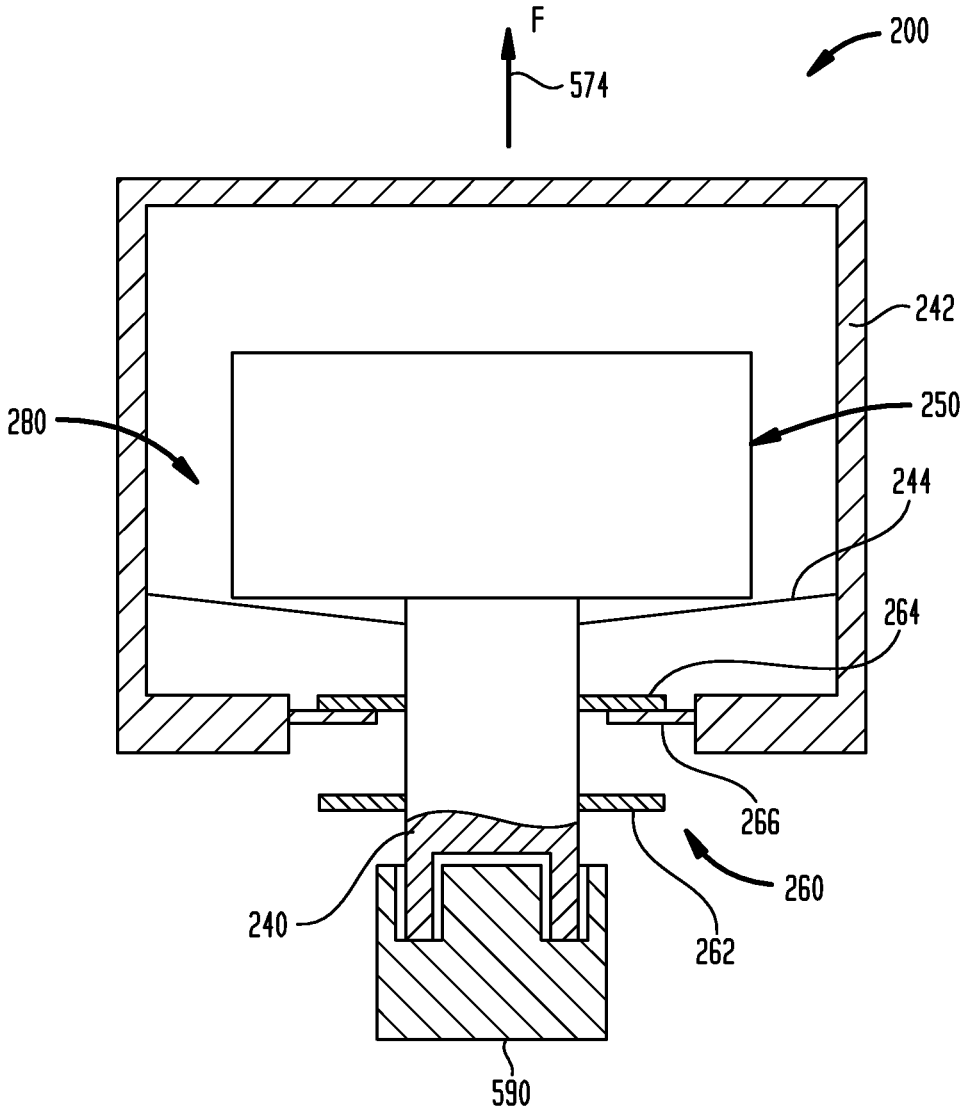
FIG. 5B is a schematic diagram of an embodiment of the bone conduction device of FIG. 2 depicting movement of the housing relative to the vibrating actuator-coupling assembly when an upward force is applied to the housing.

FIG. 5B provides a diagram depicting movement of the housing 242 relative to the vibrating actuator-coupling assembly 280 as a result of an upward force 574 (a removal force) applied to the bone conduction device 200. In FIG. 5B, abutment 590 of an anchor system attached to a recipient's skull reacts against that upward force 574, at least until the coupling apparatus 240 is decoupled from abutment 590, preventing the vibrating actuator-coupling assembly 280 from moving further upward. The upward movement of the housing 242 is limited by travel limit apparatus 260, as may be seen in FIG. 5B. Specifically, in FIG. 5B, platform flange 266 strikes stop washer 264 to halt further travel of housing 242. This also prevents vibrating actuator 250 from striking the housing 242 (the bottom portion of the housing 242 as opposed to the top portion of the housing 242, in this scenario). This prevents damage to vibrating actuator 250 and also prevents damage to spring 244.

Accordingly, referring back to FIG. 3, the stop washer 364 limits the likelihood that a removal force applied to the housing 342 (a force applied in the opposite direction of force 370), while the coupling apparatus 340 is attached to the recipient via the anchor system, will cause damage to components of the bone conduction device 300 (as is correspondingly depicted in FIG. 5B). Such damage may include plastic deformation to external spring 344.

Still referring to FIG. 3, the stop flange and stop washer 362 and 364 are positioned with respect to the platform flange 366 such that the platform flange 366 cannot travel a distance that would result in elimination of the air gap 348 between the ceiling 342*a* of the housing 342 and the bobbin assembly 354. That is, in an exemplary embodiment, the platform flange 366 of the travel limit apparatus 360 strikes the stop flange 362 before the ceiling 342*a* strikes the bobbin assembly 354. When the platform flange 366 strikes the stop flange 362, as may occur when the recipient applies the attachment force 370 to the housing, travel of the housing 342 is halted relative to the coupling apparatus 340, and thus the vibrating actuator 350. In such an embodiment, the vibrating actuator 350 is protected from the aforementioned damage due to the elimination of the air gap 348, and, ultimately, the elimination of the air gap 358 in the vibrating actuator 350.

In the embodiment of FIGS. 3 and 4, the travel limit apparatus 360 is configured to permit the housing 342 to only move relative to the coupling apparatus over a first distance. This first distance is less than and encompassed by a second distance through which the housing 342 moves relative to the coupling apparatus in the absence of the travel limit apparatus 360. In an exemplary embodiment, this second distance could be of sufficient distance to permit the vibrating actuator 350 to strike the ceiling 342*a*. In an embodiment, the housing 342 is configured to move relative to the coupling apparatus 340 and the vibrating actuator 350 over a third distance as a result of vibration of the vibrating actuator 350. That is, in an exemplary embodiment, some vibratory energy may travel from the vibrating actuator 350 to the spring 344 that will cause the housing 342 to move relative to the coupling apparatus 340 and the vibrating actuator 350. This third distance is less than and encompassed by the aforementioned first distance and the second distance. In an embodiment, the travel limit apparatus 360 permits movement of the housing 342 relative to the coupling apparatus 340 over a distance that is greater than that resulting from vibration of the vibrating actuator 350.

In an embodiment, the travel limit apparatus 360 of FIGS. 3 and 4 not only limits travel of the housing 342 along the longitudinal axis 340*a*, it also limits travel of the housing 342 in the lateral direction (i.e., radially about the longitudinal axis 340*a*) relative to the coupling apparatus 340. Referring to FIG. 4, stop flange 362 has an exterior diameter dimensioned such that an interior diameter of the housing 342 opposite the exterior diameter results in a limited air gap 368 between the outside diameter of the stop flange 362 and the interior diameter of the housing 340. Thus, if a significant lateral force is applied to the housing 342 when the coupling apparatus 340 is attached to the recipient, the housing 342 will move only a limited distance (i.e., the width of the air gap 368) before striking the exterior diameter of the stop flange 362, after which further movement of the housing 342 relative to the coupling apparatus 340 will be stopped. This further limits damage to such components as the vibrating actuator 350 and/or the external spring 344, etc.

Figure 6A:
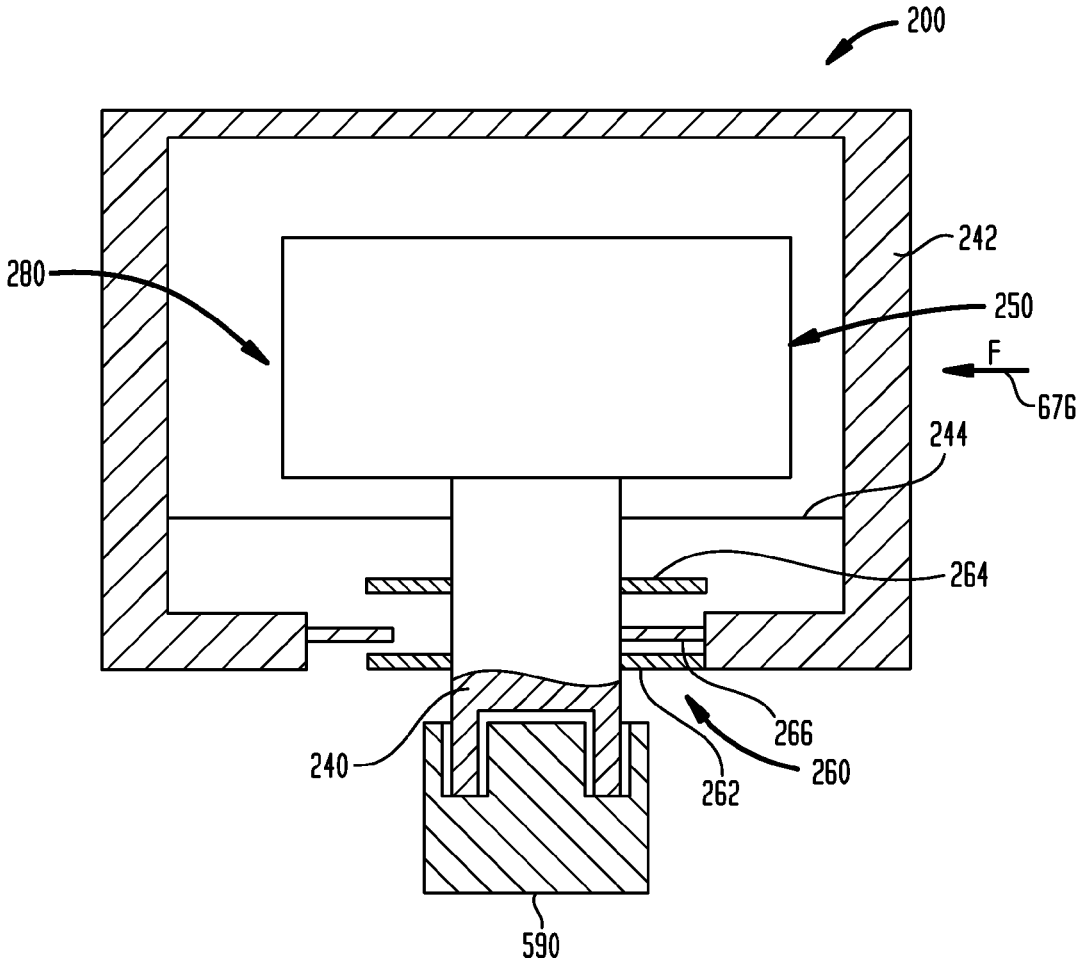
FIG. 6A is a schematic diagram of an embodiment of the bone conduction device of FIG. 2 depicting movement of the housing relative to the vibrating actuator-coupling assembly when a lateral force is applied to the housing.

FIG. 6A provides a diagram depicting movement of the housing 242 of FIG. 2 relative to the vibrating actuator-coupling assembly 280 as a result of a lateral force 676 applied to the bone conduction device 200. In FIG. 6A, abutment 590 of an anchor system attached to a recipient's skull reacts against that lateral force 676, preventing the vibrating actuator-coupling assembly 280 from moving in the direction of force 676. The lateral movement of the housing 242 is limited by travel limit apparatus 260, as may be seen in FIG. 6A. Specifically, the right edge of stop flange 262 strikes an interior surface of housing 242, thus halting further movement of the housing 242 towards the vibrating actuator-coupling assembly 280.

Referring back to FIG. 3, the travel limit apparatus 360 is also configured to limit travel of the housing 342 relative to the coupling apparatus 340 in a tilting direction. That is, referring to FIG. 3, if a rotational moment 372 is applied to housing 342 relative to the lateral direction of the coupling apparatus 340 (i.e., a rotational moment about an axis normal to axis 340*a*), the travel limit apparatus 360 will limit the resulting rotational movement of the housing 342 relative to the coupling apparatus 340.

Figure 6B:
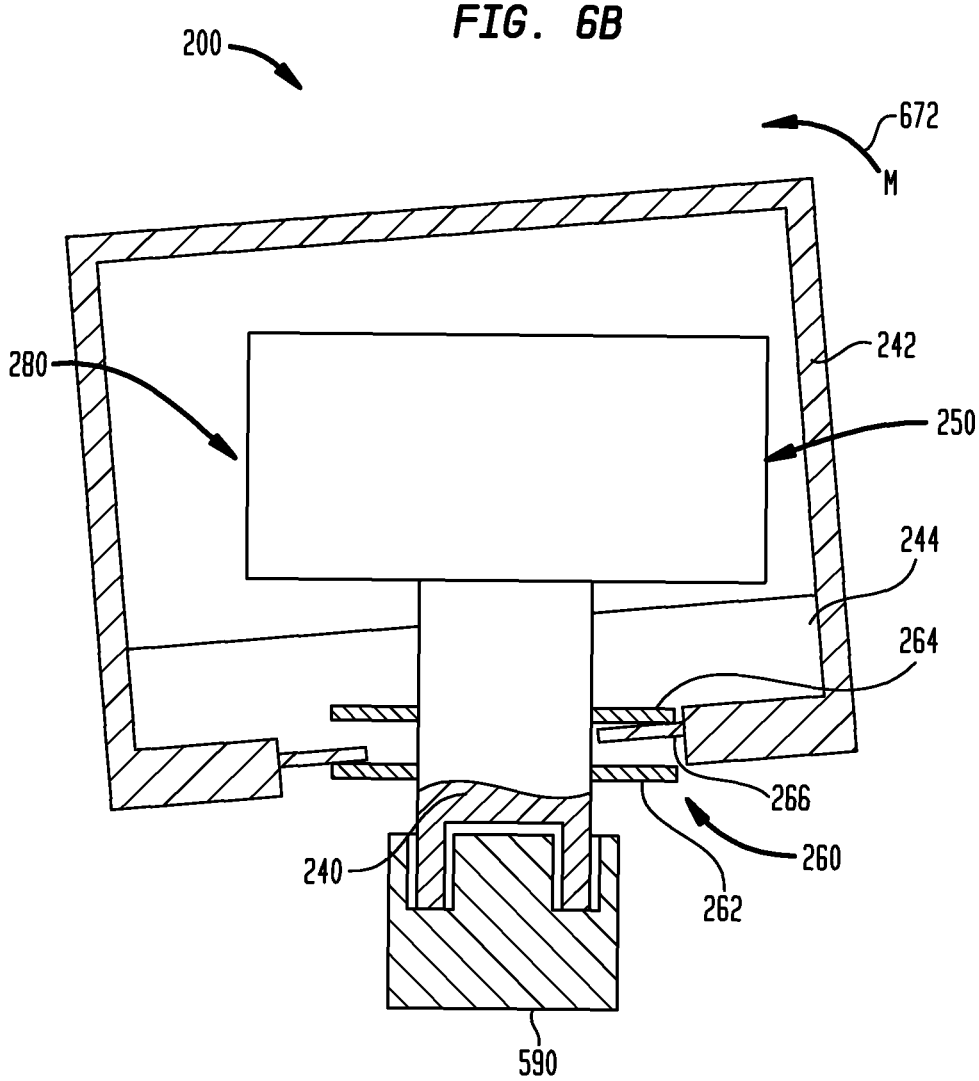
FIG. 6B is a schematic diagram of an embodiment of the bone conduction device of FIG. 2 depicting movement of the housing relative to the vibrating actuator-coupling assembly when a tilting moment is applied to the housing.

FIG. 6B provides a diagram depicting movement of the housing 242 of FIG. 2 relative to the vibrating actuator-coupling assembly 280 as a result of a rotational moment 672 applied to the bone conduction device 200. In FIG. 6B, abutment 590 of an anchor system attached to a recipient's skull reacts against that rotational moment 672, preventing the vibrating actuator-coupling assembly 280 from tilting in the direction of rotational moment 672. The tilting movement of the housing 242 is limited by travel limit apparatus 260, as may be seen in FIG. 6B. Specifically, platform flange 266 strikes the top surface of stop flange 262, thus halting further tilting of the housing 242. Also at the same time, platform flange 266 strikes the bottom surface of stop washer 264, also halting further tilting of housing 242.

In the exemplary embodiment of FIGS. 3 and 4, when viewed along that longitudinal axis 340*a*, the structural elements of the travel limit apparatus 360 overlap each other. In an exemplary embodiment, the structural elements of the travel limit apparatus linked to the coupling apparatus 340 (stop flange 362 and stop washer 364) and the structural elements of the travel limit apparatus linked to the housing 342 (platform flange 366) are coaxial to each other. In such an embodiment, an interior diameter of platform flange 366 is smaller than an exterior diameter of one or both of stop flange 362 and stop washer 364, as may be seen in FIG. 3.

In an exemplary embodiment, stop flange 362 and stop washer 364 extend in the lateral direction normal to and away from the longitudinal axis 340*a* of the coupling apparatus 340, and platform flange 366 extends in the lateral direction normal to and towards the longitudinal axis 340*a* of the coupling apparatus 340. In some embodiments, the structural elements may extend in a direction that is different from a direction normal to the longitudinal axis 342. By way of example, with reference to FIG. 3, structural element 362 may extend downward and structural element 364 may extend upward to form a "V" shape. In such an arrangement, structural element 366 is located in the "V" shape.

In an exemplary embodiment, the stop flange 362 and the stop washer 364 of the travel limit apparatus 360 are dimensioned to have an outside diameter that arcs in a circle over 360 degrees, and the platform flange 366 of the travel limit apparatus 360 is dimensioned to have an inside diameter that arcs in a circle over 360 degrees. In an embodiment, when viewed along axis 340*a*, these diameters form circular shapes that are concentric with one another.

In another embodiment, the stop flange 362 and/or the stop washer 364 of the travel limit apparatus 360 may instead be dimensioned so that the outside diameter arcs in a circular shape extending less than 360 degrees, and the platform flange 366 of the travel limit apparatus 360 may be dimensioned so that the inside diameter arcs in a circular shape that extends less than 360 degrees (e.g., forming a half-moon shape when viewed along axis 340*a*). Although the embodiments of FIGS. 3 and 4 were discussed with reference to first structural element 362, second structural element 364 and third structural element 366 being a stop flange 362, a stop washer 364 and a platform flange 366, respectively, it should be noted that in some embodiments, the structural elements may be any other type of structural element(s). For example, the structural elements of the travel limit apparatus may have shapes other than circular shapes. For example, the structural elements of the travel limit apparatus may have an outside diameter that forms a square shape or a rectangular shape, etc., when viewed along axis 340*a*. Still further, the structural elements of the travel limit apparatus 360 may be in the form of cantilever beams extending from the coupling apparatus 340 and/or the housing 342 having rectangular cross-sections, circular cross-sections, I beam cross-sections, etc., that contact each other when the housing 342 is sufficiently moved relative to the coupling 340 to stop further travel of the housing 342. Any form, shape or direction of the structural elements of the travel limit configured to limit travel of the coupling apparatus 340 and/or the vibrating actuator 350 may be used in some embodiments. This is the case at least if the structural elements reduce the likelihood of damage to the components of the bone conduction device 300 when the bone conduction device 300 is removed and/or attached to a recipient.

In the exemplary embodiment, the first structural element 362 of the travel limit apparatus 360, platform flange 362 is integral with the coupling apparatus 340. Further, the second structural element 364 of the travel limit apparatus 360, stop washer 364, is rigidly mechanically linked to the coupling apparatus 340, either directly, or indirectly via attachment to, for example, or being integral with the vibrating actuator shaft 353 and/or the vibrating actuator plate 352. In an exemplary embodiment, the stop washer 364 is a separate component from the coupling apparatus 340 and/or the vibrating actuator plate 352. Stop washer 364 may be fitted onto one or more of coupling apparatus 340, vibrating actuator plate 352 or vibrating actuator shaft 353 via a press fit, a slip fit along with some other mechanical securement feature, etc. In an exemplary embodiment, because the stop washer 364 is separate from the coupling apparatus 340, it enhances the manufacturability of the bone conduction device 300. For example, the coupling apparatus 340 may be inserted into the housing 342 through one side of the housing 342, and the stop washer 364 may be placed onto the coupling apparatus 340 from the other side of the housing (at least when housing 342 is an assembly of multiple housing sub-components, such as is the case with the embodiment depicted in FIG. 3), thereby "trapping" the platform flange 366 between the stop flange 362 and the stop washer 364.

In another exemplary embodiment, structural elements 362 and 364 of the travel limit apparatus 360 may be rigidly mechanically linked to the housing 342, as opposed to the coupling apparatus 340, and structural element 366 may be rigidly mechanically linked to coupling apparatus 360, as opposed to the housing 342. In an embodiment, structural elements 362, 364 and/or 366 may be of the configuration of stop washer 364 (i.e., it may be a separate component relative to the component to which it is rigidly mechanically linked). In another embodiment, structural elements 362, 364 and/or 366 may be of the configuration of stop flange 362 or platform flange 366 (i.e., it may be an integral with the component to which it is rigidly mechanically linked).

In an exemplary embodiment, the stop washer 364 is located in the interior of the bone conduction device 300 and the stop flange 362 is located on an exterior of the bone conduction device 300. Further, as illustrated in FIGS. 3 and 4, the structural elements of the travel limit apparatus 360 intermesh with one another to limit movement of the housing 342 as disclosed herein.

In yet another embodiment, one or more of the structural elements of the travel limit apparatus 360 may be configured to elastically deform a certain amount while still limiting travel as disclosed herein.

In an embodiment, the vibrating actuator 350 is a piezoelectric transducer.

Some embodiments may be practiced to limit travel of any component of the bone conduction device 300 besides vibrating actuator 350 and coupling apparatus 340 relative to one another.

As noted above, travel limit apparatus 360 of FIGS. 3 and 4 limits the potential that a component of the bone conduction device 300 may be destroyed, rendering the bone conduction device partially or completely inoperable.

In another embodiment, the travel limit apparatus 360 limits the potential that a component of the bone conduction device 300 may be damaged or otherwise experience an event that changes a performance characteristic of that component. In such a damage scenario, the damaged component may function, but it functions in a manner that is less than optimal and/or functions in a manner that has a deleterious effect on the partial performance and/or the overall performance of the bone conduction device. By way of example and not by way of limitation, if the width of the air gap 358 is permanently reduced from a design width as a result of the housing 342 striking the bobbin assembly 354, the performance of the vibrating actuator 350 may be degraded but the vibrating actuator 350 may still function. The embodiments depicted in FIGS. 3 and 4 are directed at limiting travel of components of the bone conduction device 300 to reduce the potential for such an eventuality.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A bone conduction device, comprising:

a housing;

a vibrating actuator movably suspended in the housing;

a coupling apparatus; and a travel limit apparatus comprising first, second and third structural elements, wherein the third structural element travels between the first and second structural elements to contact the first structural element and contact the second structural element to limit a range of travel of the housing relative to the coupling apparatus.

2. The bone conduction device of claim 1, wherein the first and second structural elements are rigidly mechanically linked to the coupling apparatus and the third structural element is rigidly mechanically linked to the housing and positioned between the first and second structural elements.

3. The bone conduction device of claim 1, wherein the first and second structural elements are rigidly mechanically linked to the housing and the third structural element is rigidly mechanically linked to the coupling apparatus and positioned between the first and second structural elements.

4. The bone conduction device of claim 1, wherein the coupling apparatus extends in a longitudinal direction out of the bone conduction device, and wherein the first and second structural elements are rigidly mechanically linked to the coupling apparatus, the first and second structural elements extending away from the longitudinal direction of extension of the coupling apparatus; and the third structural element is rigidly mechanically linked to the housing, the third structural element extending towards the longitudinal direction of extension of the coupling apparatus.

5. The bone conduction device of claim 1, wherein the first structural element is located on the interior of the bone conduction device and the third structural element is located on the exterior of the bone conduction device.

6. The bone conduction device of claim 1, wherein the first structural element is interposed in a first travel path of the third structural element.

7. The bone conduction device of claim 1, wherein the first structural element is configured to stop travel of the third structural element, and thus the housing, in a first direction, wherein the first direction is a direction of travel towards a distal end, relative to the housing, of the coupling apparatus, wherein the coupling apparatus includes a first coupling configured to attach the bone conduction device to a second coupling of an abutment, and wherein the first coupling is located at the distal end of the coupling apparatus.

8. The bone conduction device of claim 1, wherein the travel limit apparatus is configured to permit the housing to only travel relative to the coupling apparatus over a first distance that is less than and encompassed by a second distance through which the housing travels relative to the coupling apparatus in the absence of the travel limit apparatus, wherein the housing is configured to travel relative to the coupling apparatus over a third distance as a result of vibration of the vibrating actuator, wherein the third distance is less than and encompassed by the first distance and the second distance.

9. The bone conduction device of claim 1, wherein the travel limit apparatus permits travel of the housing relative to the coupling apparatus over a distance that is greater than that resulting from vibration of the vibrating actuator.

10. The bone conduction device of claim 1, wherein the travel limit apparatus is configured to limit a range travel of the housing relative to the coupling apparatus along a longitudinal axis of the coupling apparatus, radially about the longitudinal axis of the coupling apparatus and rotationally about an axis normal to the longitudinal axis of the coupling apparatus.

11. The bone conduction device of claim 1, wherein the coupling apparatus is movably suspended from the housing by a spring, wherein the vibrating actuator is supported by the coupling apparatus, and wherein the spring elastically deforms when the housing travels relative to the coupling apparatus.

12. A bone conduction device, comprising:

a housing;

a vibrating actuator movably suspended in the housing;

a coupling apparatus; and a travel limit apparatus configured to limit a range of travel of the housing relative to the vibrating actuator, wherein the travel limit apparatus comprises first, second and third structural elements, wherein the third structural element travels between the first and second structural elements to contact the first structural element and contact the second structural element.

13. The bone conduction device of claim 12, wherein the vibrating actuator is movably suspended in the housing by a spring, wherein the spring is configured to permit the housing to travel relative to the vibrating actuator, and wherein the travel limit apparatus is configured to limit a range of deformation of the spring.

14. The bone conduction device of claim 13, wherein the travel limit apparatus is configured to prevent plastic deformation of the spring resulting from travel of the housing relative to the vibrating actuator.

15. The bone conduction device of claim 13, wherein the travel limit apparatus limits the range of deformation of the spring by limiting travel of the housing relative to the coupling apparatus, and thus travel of the housing relative to the vibrating actuator.

16. The bone conduction device of claim 12, wherein the vibrating actuator includes a first component that travels relative to a second component to generate vibrations, wherein the second component is rigidly mechanically linked to the coupling apparatus, and wherein the travel limit apparatus prevents the first component from contacting the housing when the housing moves relative to the vibrating actuator.

17. The bone conduction device of claim 12, wherein the travel limit apparatus is configured so that a force applied to the housing results in travel of the vibrating actuator towards the housing and causes the third structural element of the travel limit apparatus, which is rigidly mechanically linked to the housing, to contact the first or second structural element of the travel limit apparatus, which is rigidly mechanically linked to the coupling apparatus, before the vibrating actuator contacts the housing.

18. The bone conduction device of claim 12, wherein the travel limit apparatus is configured to permit the housing to only travel relative to the vibrating actuator over a first distance that is less than and encompassed by a second distance through which the housing travels relative to the vibrating actuator in the absence of the travel limit apparatus, and wherein the housing is configured to travel relative to the vibrating actuator over a third distance as a result of vibration of the vibrating actuator, wherein the third distance is less than and encompassed by the first distance and the second distance.

19. The bone conduction device of claim 12, wherein the travel limit apparatus permits travel of the housing relative to the vibrating actuator over a distance that is greater than that resulting from vibration of the vibrating actuator.

20. The bone conduction device of claim 12, wherein the vibrating actuator includes a first air gap between a first component that travels relative to a second component to generate vibrations, wherein the bone conduction device includes a second air gap between the first component and the housing having a width that changes with travel of the housing relative to the vibrating actuator, wherein the travel limit apparatus is configured to prevent the second air gap from being eliminated and thus prevent the first air gap from being eliminated.

21. A method for preventing damage to a bone conduction device, the device having a vibrating actuator attached to a coupling apparatus, and first and second structural elements rigidly mechanically linked to the coupling apparatus, wherein the coupling apparatus is movably suspended from a housing, and wherein a third structural element is rigidly mechanically linked to the housing, the method comprising:

receiving a force applied to the housing; and while the force is applied to the housing:

moving the housing relative to the coupling apparatus and the vibrating actuator in response to the force; and mechanically stopping the relative travel of the housing to the coupling apparatus prior to the vibrating actuator contacting the housing wherein the third structural element contacts the first structural element and contacts the second structural element.

22. The method of claim 21, wherein the force applied to the housing is sufficient to act against reaction forces in a suspension system suspending the coupling apparatus from the housing to cause the housing to travel relative to the coupling apparatus and the vibrating actuator over a first distance bounded by the suspension system, and wherein the action of mechanically stopping the relative travel of the housing to the coupling apparatus comprises mechanically preventing travel of the housing more than a second distance that is encompassed by the first distance.

23. A bone conduction device, comprising:

a housing;

a vibrating actuator movably suspended in the housing;

a coupling apparatus; and a travel limit apparatus configured to limit a range of travel of the housing relative to the coupling apparatus, comprising:

first and second structural elements rigidly mechanically linked to the coupling apparatus; and third and fourth structural elements rigidly mechanically linked to the housing, wherein when the vibrating actuator travels in a first direction the third structural element contacts the first structural element to limit the range of travel of the housing relative to the coupling apparatus, and when the vibrating actuator travels in a second direction, the fourth structural element contacts the second structural element to limit the range of travel of the housing relative to the coupling apparatus.

24. The bone conduction device of claim 23, wherein the vibrating actuator is configured to reciprocatingly travel along a first axis to deliver vibrations to a recipient's skull, wherein the bone conduction device is configured to permit the housing to reciprocatingly travel along the first axis, and wherein the travel limit apparatus limits the range of travel of the housing relative to the coupling apparatus along the first axis.

25. The bone conduction device of claim 24, wherein the first structural element and the third structural element physically overlap with one another when viewed along the first axis.

26. The bone conduction device of claim 24, wherein both the first structural element and the third structural element include at least one of inner and outer dimensions that form concentric and overlapping circles when viewed along the first axis.

27. The bone conduction device of claim 23, wherein the third structural element and the fourth structural element are a single structural element.

28. The bone conduction device of claim 23, wherein the bone conduction device is configured to couple to an abutment of an anchor system anchored to a recipient's skull, wherein the vibrating actuator is configured to vibrate in response to sound signals received by the bone conduction device, and wherein the coupling apparatus is configured to attach the bone conduction device to the abutment so as to deliver to the recipient's skull vibrations generated by the vibrating actuator.

29. The bone conduction device of claim 28, wherein the coupling apparatus is configured to snap lock to the abutment.

* * * * *